US005451082A

United States Patent [19]

Murai

[11] Patent Number: 5,451,082

[45] Date of Patent: Sep. 19, 1995

[54] LOCK FASTENER

[75] Inventor: Ryukichi Murai, Toyama, Japan

[73] Assignee: Yoshida Kogyo K.K., Tokyo, Japan

[21] Appl. No.: 104,558

[22] Filed: Aug. 11, 1993

[30] Foreign Application Priority Data

Aug. 12, 1992 [JP] Japan ..... 4-056683 U
May 31, 1993 [JP] Japan ..... 5-028803 U

[51] Int. Cl.[6] ..... E05C 19/10

[52] U.S. Cl. ..... 292/246; 292/341.15; 292/DIG. 38; 292/DIG. 50; 24/115 G; 24/658

[58] Field of Search ..... 292/146, 246, 302, DIG. 38, 292/DIG. 50, 150, 175, 341.15; 24/652.707.1, 656, 658, 115 G

[56] References Cited

U.S. PATENT DOCUMENTS

| | | | |
|---|---|---|---|
| 133,693 | 12/1872 | Bardwell | 24/658 |
| 492,521 | 2/1893 | Ortner | 24/658 |
| 493,559 | 3/1893 | Pfenning | 24/656 X |
| 2,970,858 | 2/1961 | Norrenberg-Sudhaus | 292/175 X |
| 3,612,592 | 10/1971 | Reitzel | 292/302 X |
| 4,704,772 | 11/1987 | Kasai . | |
| 4,724,584 | 2/1988 | Kasai | 24/115 G |
| 5,193,707 | 3/1993 | Mizumura | 292/175 X |

FOREIGN PATENT DOCUMENTS

| | | | |
|---|---|---|---|
| 0466446 | 1/1992 | European Pat. Off. . | |
| 0467761 | 1/1992 | France . | |
| 586867 | 10/1933 | Germany | 24/652 |
| 3535623 | 4/1987 | Germany | 24/115 G |
| 55-44500 | 10/1980 | Japan . | |
| 2-39373 | 10/1990 | Japan . | |
| 2-42171 | 11/1990 | Japan . | |
| 4-56020 | 5/1992 | Japan . | |
| 4-74034 | 6/1992 | Japan . | |
| 69961 | 1/1946 | Norway | 292/302 |
| 72087 | 9/1929 | Sweden | 292/302 |
| 92409 | 5/1938 | Sweden | 292/302 |
| 1528401 | 10/1978 | United Kingdom | 292/DIG. 38 |
| 2161532 | 1/1986 | United Kingdom . | |

*Primary Examiner*—Rodney M. Lindsey
*Attorney, Agent, or Firm*—Hill, Steadman & Simpson

[57] ABSTRACT

A lock fastener for attachment to a bag or the like comprises a socket member and a plug member releasably engageable therewith. A slide member has resilient means for supporting the slide member resiliently movably within the socket member. The socket member and the slide member are provided with respective circular apertures and of substantially equal diameter which are brought out of registry to lock and into registry to unlock the plug member relative to the socket member.

6 Claims, 8 Drawing Sheets

LOCK FASTENER

BACKGROUND OF THE INVENTION

1. Field of the Invention

This invention relates to a lock fastener for bags and other receptacles adapted to be closed by a cover or flap.

2. Prior Art

There are known a variety of lock fasteners of the type mentioned for use in opening and closing bags, suitcases or the like.

A typical example of such lock fastener in and relating to which the present invention contemplates improvements is disclosed in Japanese Utility Model Publication No. 2-39373 which introduces a button-like fastener comprising a hook member having a locking head on a front web of a handbag body and a grommet having a slide on a flap or cover, the arrangement being that the locking head is releasably received in a guide slot formed in the slide and the slide is moved forward in one direction to lock and backward in the opposite direction to unlock the hook member relative to the grommet.

The above prior art device is somewhat tedious in operation as the slide has to be moved in one direction to ensure anchoring of the locking head in a mating hole formed in the slide and in the opposite direction to release the locking head. Another drawback is that the slide as it is projecting above the grommet, is liable to catch some ambient objects and thereby move unintentionally to unlock the bag.

SUMMARY OF THE INVENTION

With the foregoing drawbacks of the prior art device in view, the present invention seeks to provide a lock fastener comprising component parts which are simple to assemble and easy to operate.

The above and other objects, fasteners and advantages of the invention will be apparent from the following detailed description taken in connection with the accompanying drawings which illustrate by way of example a preferred embodiment.

According to the invention, there is provided a lock fastener which comprises a socket member having a circular aperture, a plug member releasably engageable with the said socket member, and a slide member having a circular member and resilient means for supporting said slide member resiliently movably within the socket member, the plug member having a locking head adapted to releasably engage through the apertures and lock the plug member in position relative to the socket member.

BRIEF DESCRIPTION OF THE DRAWINGS

Like reference numerals refer to like or corresponding parts throughout the several views.

DETAILED DESCRIPTION OF THE INVENTION

Figure 1:
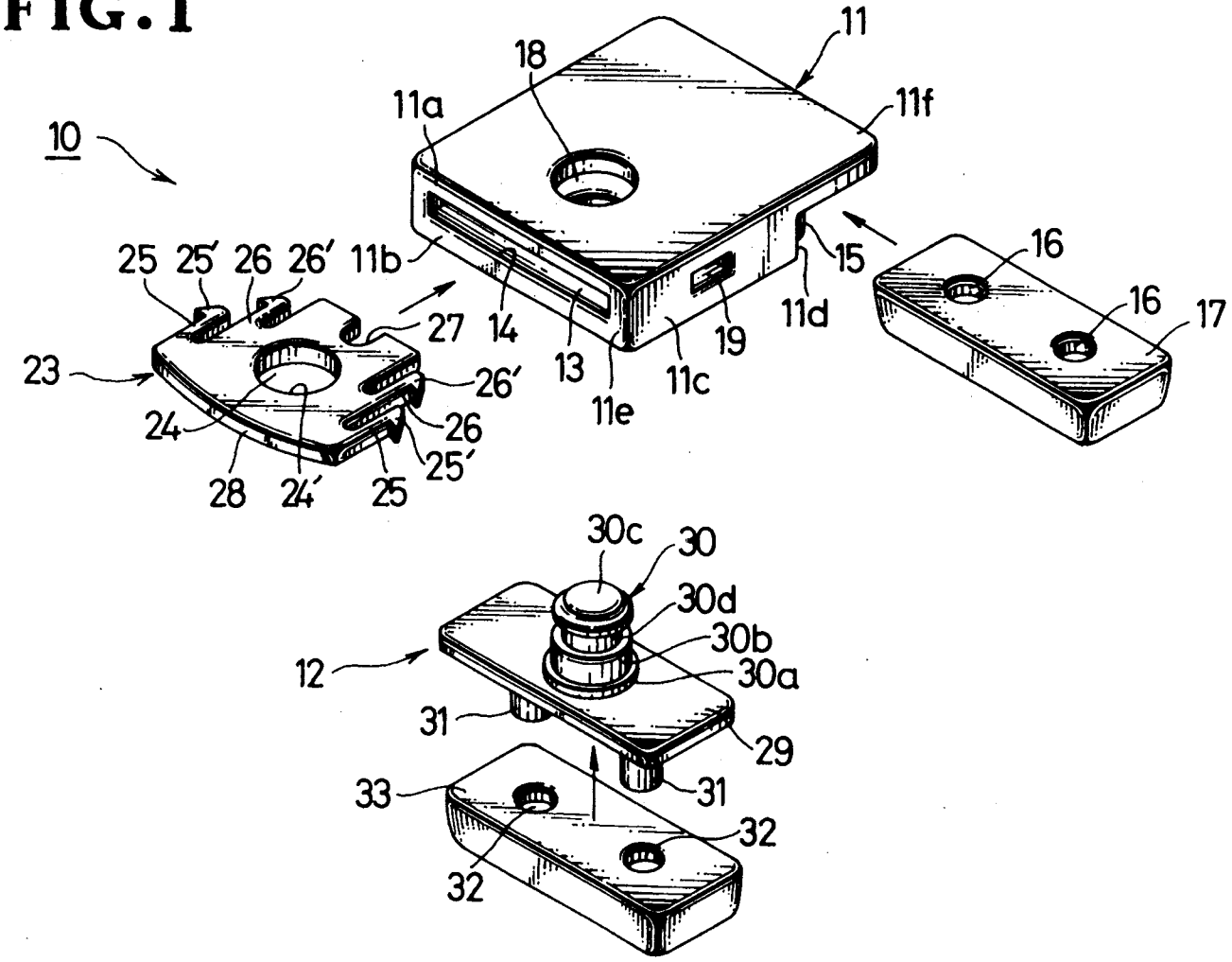
FIG. 1 is an exploded perspective view of a lock fastener embodying the invention.

Referring now to the drawings and FIG. 1 in particular, there is shown a lock fastener 10 constructed in accordance with the invention which essentially comprises a socket or female member 11 and a plug or male member 12 releasably engageable therewith. The socket member 11 is generally in the form of a rectangular box having an upper plate 11*a* and a lower plate 11*b* joined together in spaced relation by a pair of side flanges 11*c*, 11*c* to define therebetween a chamber 13, a rear end wall 11*d* closing the chamber 13 and a front end wall 11*e*. An elongated opening 14 is formed in the front end wall 11*e* in communication with the chamber 13. An extension 11*f* of the upper plate 11*a* extends rearwardly from the rear end wall 11*d* and has a pair of mounting bolts 15, 15 extending downwardly therefrom for engagement in corresponding holes 16, 16 formed in a mounting plate 17.

A circular aperture 18 is formed centrally in the upper plate 11*a* in communication with the chamber 13 for receptive engagement with the plug member 12 in a manner hereinafter to be described.

A pair of openings 19, 19 are formed in the side flanges 11*c*, 11*c* in communication with the chamber 13. On opposite sides of each of the openings 19, 19 are formed an anchoring rib 20 integral with the flange 11*c* and having a surface 20' slanted downwardly with respect to the transuerse axis of the socket member 11 and a projection 21 extending from the rear end wall 11*d* and having a tapered surface 21' as better shown in FIGS. 2 and 3. A prong 22 extends centrally from the rear end wall 11*d* inwardly toward the circular aperture 18 as also shown in FIGS. 2 and 3.

Figure 2:
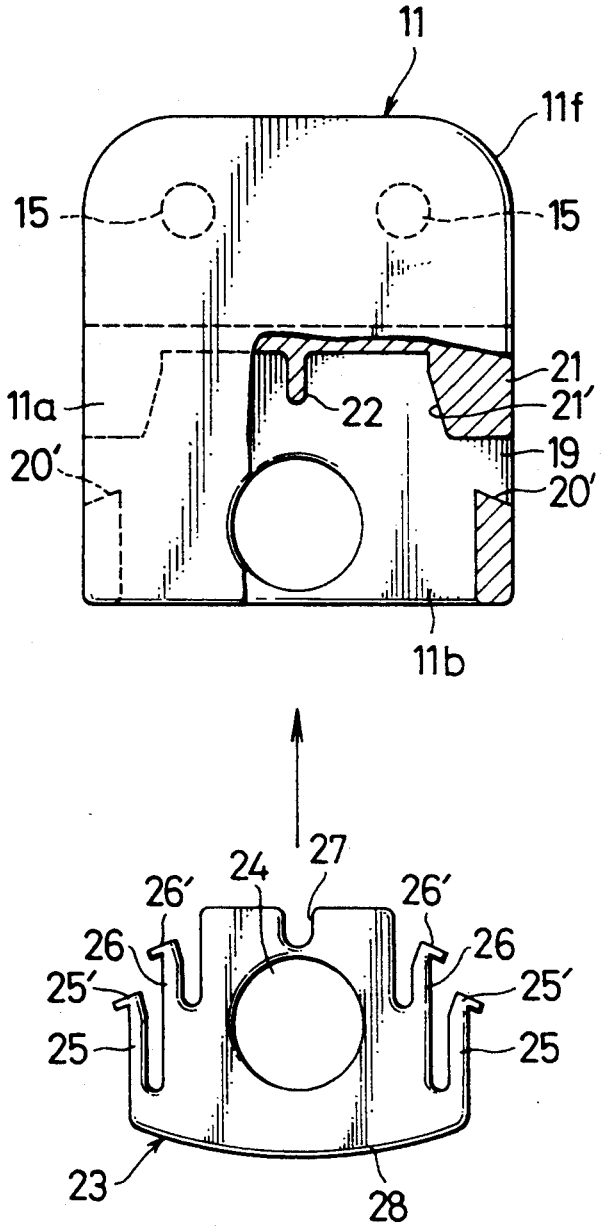
FIG. 2 is a plan view, partly broken away, of a socket member constituting a female part of the fastener and a slide member associated therewith.
Figure 3:
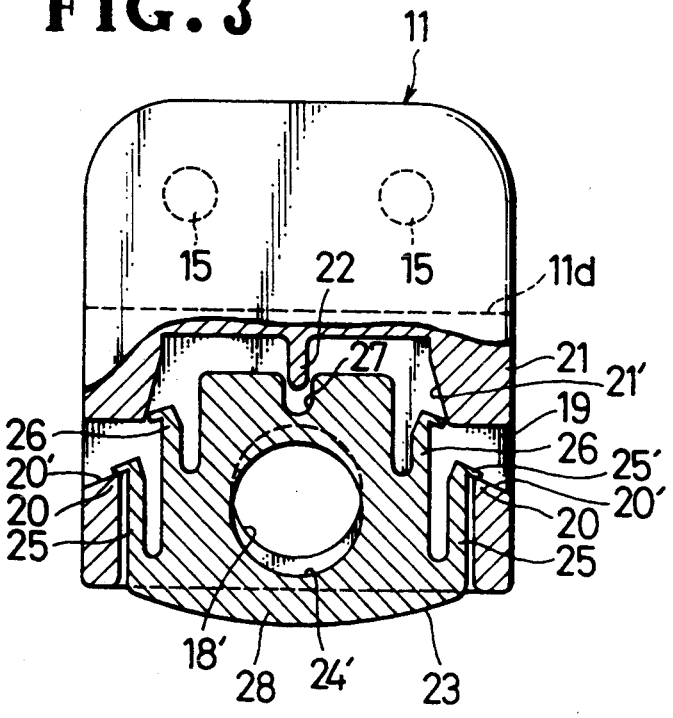
FIG. 3 is a plan view, partly broken away, of the socket member and the slide member joined together.
Figure 4:
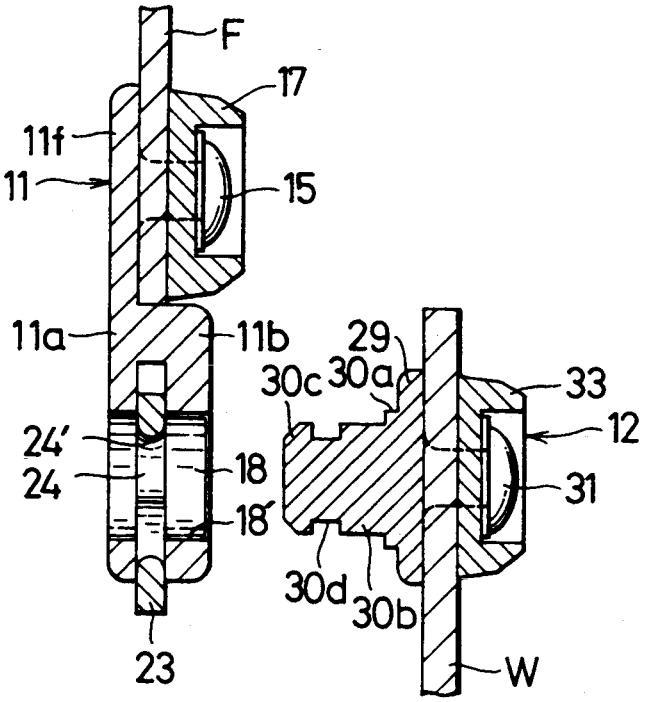
FIG. 4 is a longitudinal cross-sectional view of each of the socket member secured to a flap of a handbag (FIG. 7) and a plug member; e.g. male part of the fastener, secured to a front web of the handbag.

Designated at 23 and as better shown in FIG. 2 is a slide member having formed centrally therein a circular aperture 24 equal in diameter with the circular aperture 18 of the socket member 11. A pair of first resilient engaging fingers 25, 25 having respective outwardly directed nails 25', 25' and a pair of second resilient engaging fingers 26, 26 having respective outwardly directed nails 26',26' are formed symmetrically on opposite sides of the slide member 23. The first and second fingers 25, 25, and 26, 26 are spaced apart with the nails 26', 26' of the second fingers 26, 26 disposed above the nails 25', 25' of the first fingers 25, 25 such that the second fingers 26, 26 engage with the anchoring ribs 20, 20 and the projection 21, 21, respectively, of the socket member 11 as better shown in FIG. 3 in a manner hereinafter to be described. The slide member 23 is also provided at its front end between the pair of the second engaging fingers 26, 26 with an indent 27 for receptive engagement with the prong 22 of the socket member 11 and at its rear end with an arcuate handle portion 28 for manipulating the slide member 23 relative to the socket member 11, as also shown in FIG. 3.

The plug member 12 has a base 29 and a locking head 30 projecting upwardly therefrom for engagement with the socket member 11. The locking head 30 includes an annular flange 30*a* larger in diameter than the circular apertures 18 and 24, a fitting ring 30*b* slightly smaller in diameter than and adapted for fitting engagement with the circular apertures 18 and 24 and a retaining ring 30*c* similar in diameter to the fitting ring 30*b* but separated therefrom by a reduced neck 30*d*.

Extending downwardly from the base 29 of the plug member 12 are a pair of mounting bolts 31, 31 for fitting engagement in corresponding holes 32, 32 formed in a mounting plate 33 to be attached to the bag.

Figure 12:
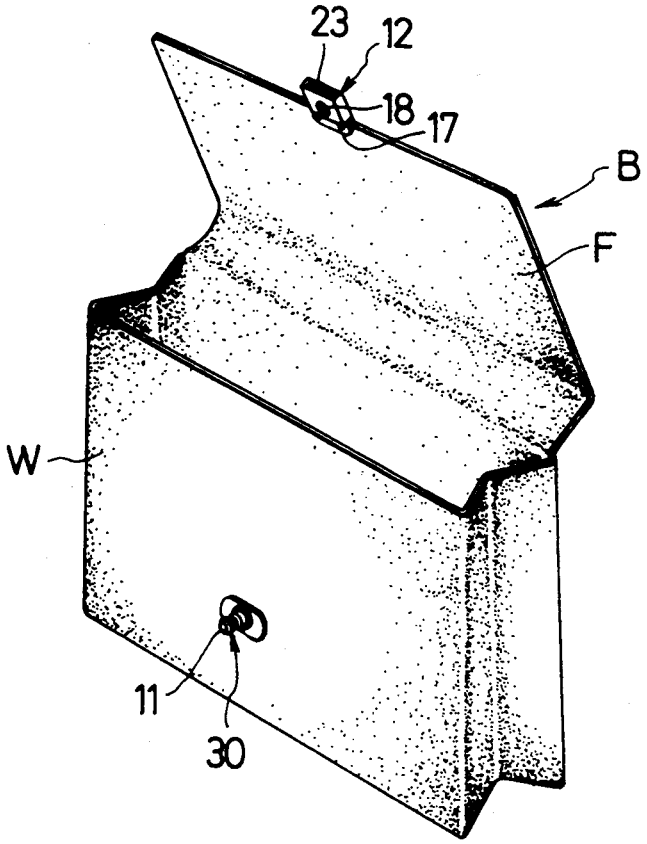
FIG. 12 is a perspective view of a handbag attached with the lock fastener of the invention.

In assembling the lock fastener 10, the slide member 23 is inserted through the opening 14 into the chamber 13 of the socket member 11, in which instance with advancement of the slide member 23 the first engaging fingers 25, 25 flex inwardly toward each other until their respective nails 25', 25' are brought into hooked engagement with the slanted surfaces 20', 20' of the anchoring ribs 20, 20, while at the same time the nails 26', 26' of the second engaging fingers 26, 26 abut resiliently against the tapered surfaces 21', 21' of the projections 21, 21, with the prong 22 received in the indent (27) to hold the slide member 23 in place against lateral displacement as illustrated in FIG. 3. With the slide member 23 thus mounted in the socket member 11, the circular opening 18 of the socket member 11 is displaced relative to or held out of registry with the circular opening 24 of the slide member 23, that is, with part of the peripheral edge 24' of the opening 24 disposed outwardly slightly beyond the peripheral edge 18' of the opening 18 as better shown in FIG. 3. The socket member 11 is secured to the flap F of the handbag B with the aid of the mounting plate 17 and the bolts 15, 15 which may be fastened with nuts or the like, welded or adhesively secured in place as shown in FIG. 12.

The plug member 12 is secured to the front web W of the handbag B also in a manner similar to the socket member 11.

Figure 5:
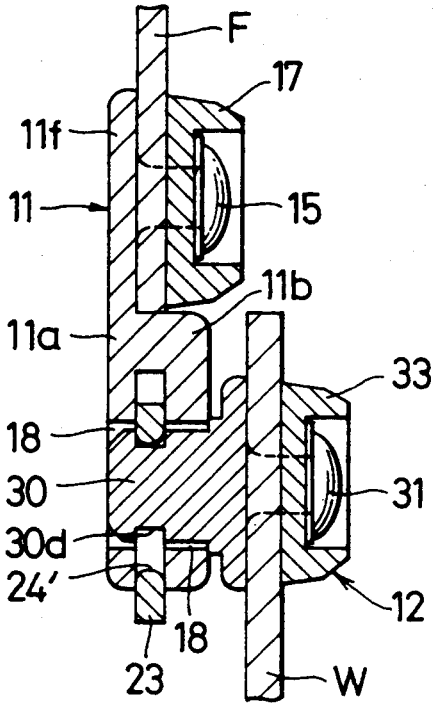
FIG. 5 is a view similar to FIG. 4 but showing the socket and plug members coupled together.

In operation of the lock fastener 10, the plug member 12 is brought into coupling engagement with the socket member 11 by inserting the locking head 30 through the two circular apertures 24 and 18, in which instance with advancement of the plug member 12 the retaining ring 30*c* comes first into abutting engagement peripherally partly with the aperture 24 of the slide member 23 and urges the latter to move slightly upward as the second engaging fingers 26, 26 are caused to slide upwardly along the tapered surfaces 21', 21' of the projections 21, 21 until the two apertures 18 and 24 are registered. As the plug member 12 is fully inserted with its reduced neck 30*d* aligned with the aperture 24, the slide member 23 is urged by the resilient bounce back action of the second fingers 26, 26 to move back downwardly until the peripheral edge 24' of the aperture 24 is captured fittingly by the reduced neck 30*d*, thereby locking the plug member 11 as shown in FIG. 5, in which position the two apertures 18 and 24 are held out of registry with each other as depicted in FIG. 3.

The plug member 12 is easily released from the socket member 11 by simply moving (by the handle portion 28) the slide member 23 slightly upwardly until the two apertures 18 and 24 of the socket and slide members, respectably, are brought into registry with each other to allow the locking head 30 to move apart therefrom.

Reference to FIG. 6 through 10 inclusive shows a modified form of lock fastener 10' which is basically similar in terms of structure and function to the lock fastener 10 herein above described in connection with FIGS. 1–5 but which is provided with such certain different and additional features that will be described in the following.

The socket member 11' is in the form of a transversely enlongated or widened block having an arcuate front end wall 11*e'* in which the elongate opening 14 is formed. The mounting plated 17' for the socket member 11' is likewise transversely elongated with opposite ends inwardly directed for the formation of mounting holes 16, 16 engageable with the holes 15, 15.

Figure 6:
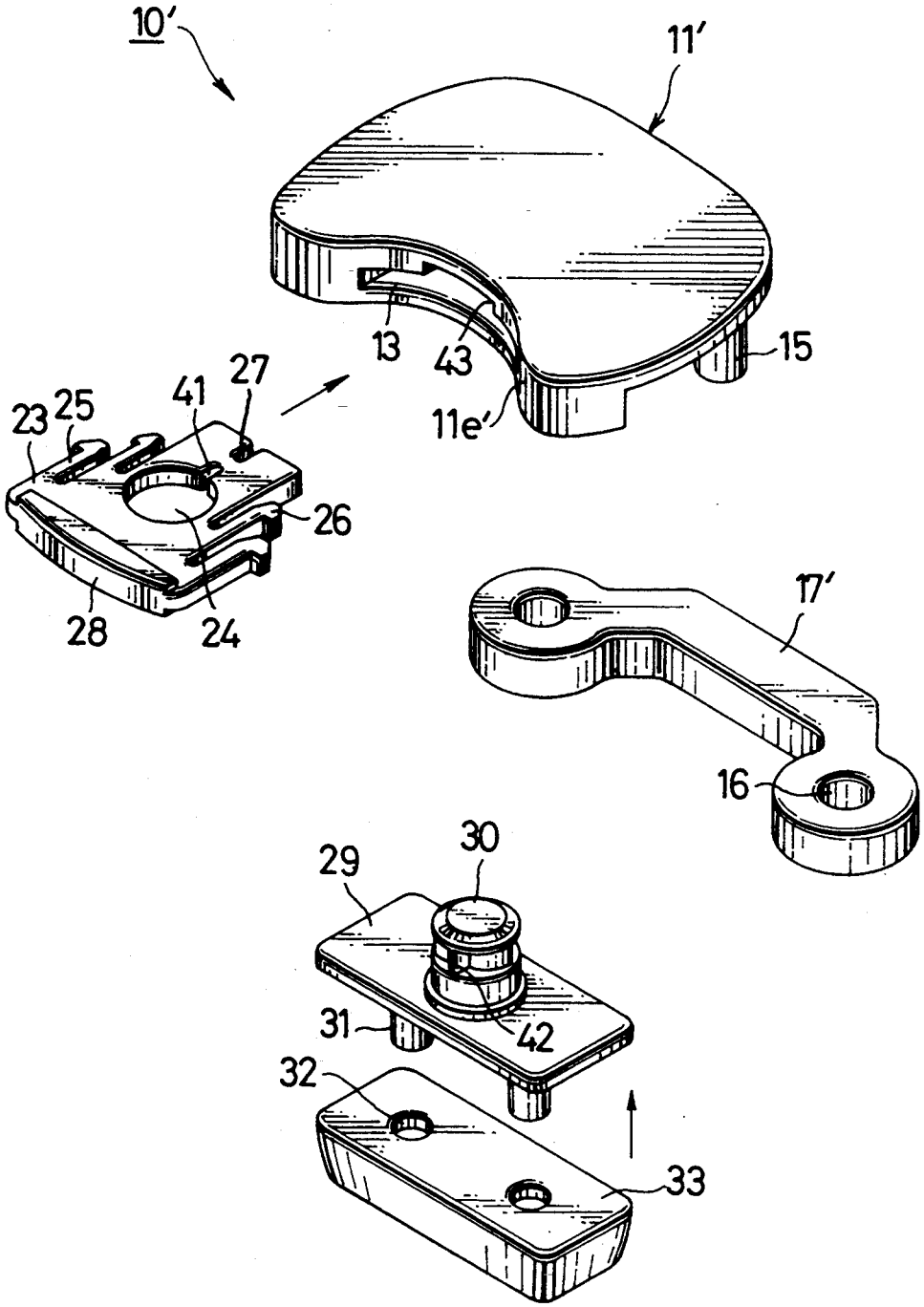
FIG. 6 is an exploded perspective view of a modified form of lock fastener according to the invention.

A slit 41 is formed in the peripheral edge 24' of the opening 24 in alignment with the indent 27 of the slide member 23 as shown in FIG. 6.

Figure 7:
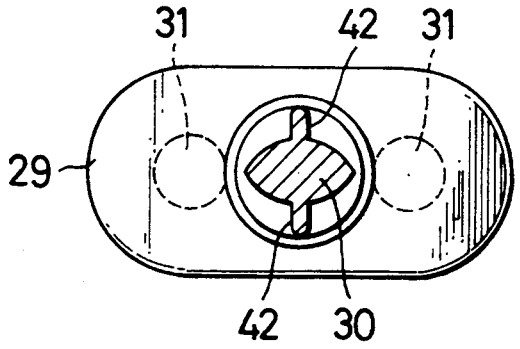
FIG. 7 is a sectional plan view of a modified plug member.
Figure 8:
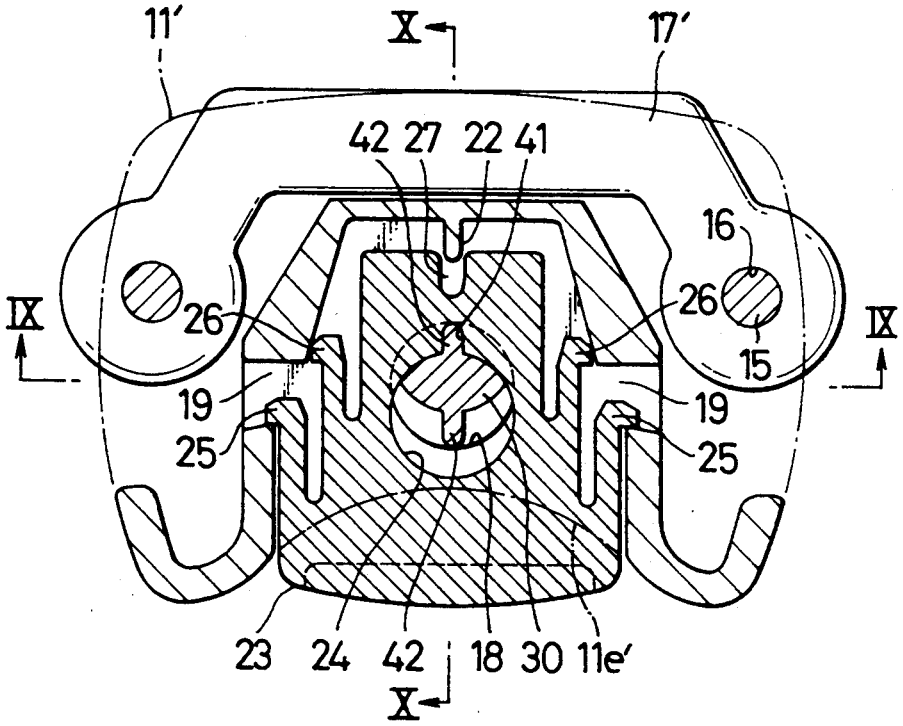
FIG. 8 is a sectional plan view of the modified lock fastener of FIG. 6 shown assembled.
Figure 9:
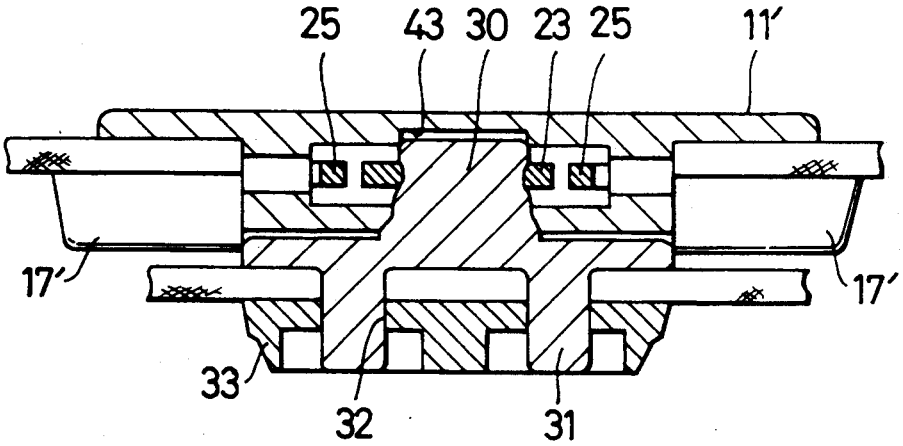
FIG. 9 is a transperse cross-sectional view taken on the line IX—IX of FIG. 8.
Figure 10:
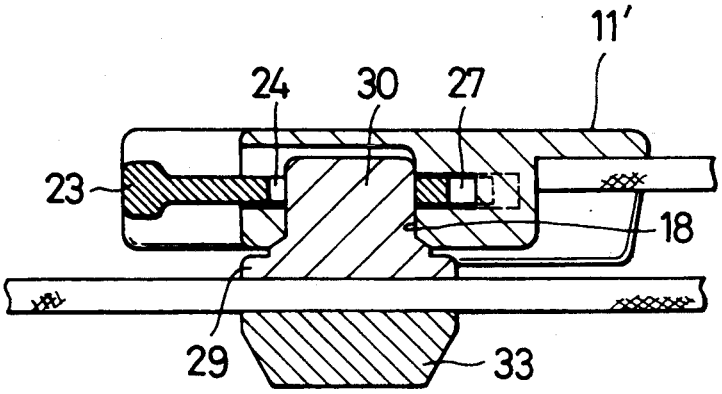
FIG. 10 is a longtudinal cross-sectional view taken on the line X—X of FIG. 8.

A pair of diammetrically opposed engaging ribs 42, 42 are formed in the periphery of the locking head 30 of the plug member 12 as better shown in FIG. 7, either of which ribs 42, 42 are adapted to engage fittingly in the slit 41 of the slide member 23 thereby to ensure positional stability of the plug member 12 relative to the socket member 11 particularly in the lateral direction of the lock fastener 10' when the latter is coupled together as shown in FIGS. 8–10.

Designated at 43 is cavity formed in the upper plate 11*a* of the socket member 11 and dimentioned to fittingly receive the retaining ring 30*c* of the locking head 30 to provide increased locking effect.

Obviously, various modifications and variations of the present invention are possible in the light of the above teaching. It is therefore to be understood that within the scope of the appended claims the invention may be practiced otherwise than as specifically described.

Figure 11:
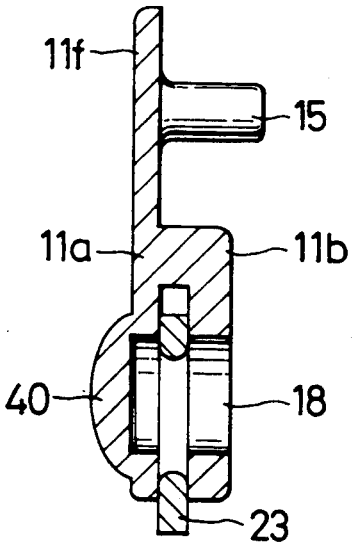
FIG. 11 is a longitudinal cross-sectional view of a modified form of socket member.

As for an example, the circular aperture 18 in the upper upper 11*a* of the socket member 11 may be closed by a cover strip 40 to provide improved appearance of the device as shown in FIG. 11.

What is claimed is:

1. A lock fastener which comprises a socket member having a circular aperture, a plug member releasably engageable with said socket member, and a slide member having a circular hole and resilient means for supporting said slide member resiliently movably within said socket member, said plug member having a locking head adapted to releasably engage through said circular aperture and said circular hole and lock said plug member in position relative to said socket member, and wherein said socket member has an anchoring rib and a tapered inner surface, and said resilient means comprises a plurality of engaging fingers resiliently engageable with said anchoring rib and resiliently slidable along said tapered inner surface, respectively.

2. A lock fastener according to claim 1 wherein said socket member has a cavity formed in an upper plate and dimensioned to fittingly receive said locking head.

3. A lock fastener according to claim 1 wherein said circular aperture and said circular hole are held out of registry with each other when said plug member is locked relative to said socket member.

4. A lock fastener according to claim 1 wherein said socket member and said plug member are provided with mounting plates to be secured to two members to be secured together.

5. A lock fastener according to claim 1 wherein said socket member is provided with a prong extending inwardly toward said aperture and said slide member is provided with an indent for receptive engagement with said prong.

6. A lock fastener according to claim 1 or 5 wherein said slide member has a slit and said plug member has an engaging rib engageable in said slit.

* * * * *